US012269652B2

(12) United States Patent
Jelich

(10) Patent No.: US 12,269,652 B2
(45) Date of Patent: Apr. 8, 2025

(54) DISPENSING CLOSURE

(71) Applicant: AptarGroup, Inc., Crystal Lake, IL (US)

(72) Inventor: Nicholas Jelich, Oconomowoc, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 450 days.

(21) Appl. No.: 17/788,377

(22) PCT Filed: Jan. 28, 2020

(86) PCT No.: PCT/US2020/015326
§ 371 (c)(1),
(2) Date: Jun. 23, 2022

(87) PCT Pub. No.: WO2021/154208
PCT Pub. Date: Aug. 5, 2021

(65) Prior Publication Data

US 2023/0023955 A1 Jan. 26, 2023

(51) Int. Cl.
*B65D 47/20* (2006.01)
*B65D 51/24* (2006.01)

(52) U.S. Cl.
CPC ..... *B65D 47/2006* (2013.01); *B65D 51/248* (2013.01)

(58) Field of Classification Search
CPC ..... B65D 51/248; B65D 47/2006
See application file for complete search history.

(56) References Cited

U.S. PATENT DOCUMENTS 4,022,464 A 5/1977 Parker
5,314,093 A 5/1994 Gross et al.
5,379,926 A 1/1995 Mueller et al.
5,622,284 A 4/1997 Sawicki
(Continued)

FOREIGN PATENT DOCUMENTS

FR 3096971 A1 12/2020

OTHER PUBLICATIONS

Written Opinion and Search Report dated Apr. 23, 2020 for PCT/US2020/015326 of which this is subject application a US National Phase.

*Primary Examiner* — Jeremy Carroll
(74) *Attorney, Agent, or Firm* — Wood, Phillips, Katz, Clark & Mortimer

(57) ABSTRACT

A dispensing closure (40) for a fluent substance-containing system, such as a container, includes a body (54) for receiving the fluent substance from the system, a locking member (56) assembled with the body (54), and a pivotable actuator (60) assembled with the locking member (56) and defining a dispensing flow passage (190) for discharging the fluent substance. The locking member (56) is rotatable relative to the body (54) from a locking position to an unlocking position to permit a user to pivot the actuator (60) from a closed position to a dispensing, open position. The body (54) has a pair of abutments (110) that extend through the locking member (56) in the locking position to prevent the actuator (60) from moving into the open position. In the unlocking position of the locking member (56), the actuator (60) is not prevented by the abutments (110) from moving into the open position.

18 Claims, 9 Drawing Sheets

(56) References Cited

U.S. PATENT DOCUMENTS

| | | | | |
|---|---|---|---|---|
| 5,676,289 | A | 10/1997 | Gross et al. | |
| 6,006,960 | A | 12/1999 | Gross | |
| 6,616,016 | B2 | 9/2003 | Hicks et al. | |
| 6,832,700 | B2 | 12/2004 | Roberts et al. | |
| 8,074,849 | B2 | 12/2011 | Domoy et al. | |
| 2004/0112927 | A1* | 6/2004 | Kaufman | B65D 47/2006 222/531 |
| 2005/0029154 | A1* | 2/2005 | Kahn | A61J 7/0076 206/540 |
| 2007/0235474 | A1 | 10/2007 | Downey et al. | |
| 2017/0158392 | A1* | 6/2017 | Hlavacek | B65D 53/02 |
| 2018/0346210 | A1 | 12/2018 | Jelich | |
| 2019/0092539 | A1* | 3/2019 | Phillips | B65D 55/024 |
| 2020/0331664 | A1* | 10/2020 | Lalier | B65D 47/2006 |

* cited by examiner

DISPENSING CLOSURE

TECHNICAL FIELD

The present invention relates generally to a dispensing closure for a container or other system that contains a fluent substance.

BACKGROUND OF THE INVENTION AND TECHNICAL PROBLEMS POSED BY THE PRIOR ART

Closures are employed to selectively prevent or permit communication between the exterior and interior of a system through an opening in the system. Such a system might take the form of a machine or a container such as a bottle or pouch, etc. A typical closure includes at least (1) a receiving structure (e.g., a body, base, fitment, etc.) at an opening to the system interior, and (2) a closing element (e.g., a lid, cover, overcap, pivotable disc top type actuator, etc.) that is cooperatively received by the receiving structure.

The receiving structure of the closure can typically be either (1) a separate structure that (a) can be attached at such a system opening, and (b) defines at least one passage through the receiving structure for communicating through such a system opening with the interior of such a system, or (2) an integral structure that is a unitary portion of such a system and that defines at least one passage through the integral structure such that the passage functions as the opening to the system, per se.

The closing element typically is movable relative to the receiving structure passage between (1) a fully closed position occluding the passage, and (2) an open position at least partially exposing the passage. Some closures may include additional elements like tamper-evident features or locking elements.

A closure specifically designed for dispensing a fluent substance may be described as a dispensing closure. Various fluent materials or substances (including oils, lotions, creams, gels, liquids, food items, granules, powders, etc.) may be packaged in a rigid, flexible, or collapsible container having a dispensing closure that can be opened and closed. A flexible container may be pressurized by a user to force the fluent substance from the container and through the closure body to dispense the fluent substance at a target region or onto a target surface area. If the container is a bottle, pouch, or other such container, then such a container with the closure mounted thereon and the contents stored therein may be characterized as a "package".

One type of dispensing closure is a toggle action type, which typically is provided with a closing element in the form of a generally flat, disc top type actuator or a domed type actuator for dispensing a fluent substance. A user of such a closure will typically encounter the actuator in a closed, non-dispensing position. The actuator may be provided with a region for being pressed upon by a user of the closure to toggle, tilt, pivot, or otherwise rotate the actuator with respect to a stationary portion of the closure (e.g., closure body), moving the actuator from the closed position into an open position such that a fluent substance may be dispensed through the closure. Such an actuator may subsequently be pressed upon by a user, at a different region of the actuator, to toggle, pivot, or otherwise rotate the actuator back into the closed, non-dispensing position.

The inventor of the present invention has noted that, in some applications, such toggle action type closures, when installed in or on a system (e.g., a container of a fluent substance), may be susceptible to a likelihood of inadvertent opening during manufacturing, shipping, or handling, which can result in premature or messy leaking of the fluent substance from the closure. The likelihood of inadvertent opening of such a closure may be prevented, or at least minimized, by applying an adhesive seal or a film wrap around at least a portion of the closure to mechanically prevent movement of the actuator until the seal or wrap has been removed by a user of the closure. Such additional seals or wraps may increase the cost of the closure, require additional manufacturing steps, or present a nuisance to the user who must remove such a seal or wrap.

The inventor of the present invention has further determined that some toggle action type closures, those having a rotational or twist-type locking mechanism, may have unacceptably large torques required of a user for effectuating the locking and unlocking operations. The inventor has further found that liquid tight sealing of such types of closures may be difficult to achieve.

The inventor of the present invention has further determined that some toggle action type closures, those having a rotational or twist-type locking mechanism, may be prone to a likelihood of inadvertent disengagement or disassembly of the actuator from the remainder of the closure body when the actuator is in its locking position and when the actuator is pressed by a user or impacted during shipping and handling.

The inventor of the present invention has determined that it would be desirable to provide an improved toggle action dispensing closure for preventing or minimizing the likelihood of inadvertent opening of the closure.

The inventor of the present invention has further determined that it would be beneficial to provide an improved toggle action dispensing closure that would facilitate repeatable and straightforward locking and unlocking of the closure by a user.

The inventor of the present invention has also determined that, in many applications, it may be desirable to provide an improved toggle action dispensing closure as part of a package wherein the closure structure facilitates or accommodates the cleaning of the closure and/or minimizes the potential for undesirable accumulation of residue, dirt, grime, etc. during the useful life of the package.

The inventor of the present invention has also determined that it would be desirable to provide an improved toggle action dispensing closure that can be configured for use with a container of a fluent substance so as to have one or more of the following advantages: (1) an improved ease of manufacture and/or assembly, and/or (ii) a reduced cost of manufacture and/or assembly.

The inventor of the present invention has invented a novel structure for a toggle action dispensing closure for use with a system, which could be a container or other type of system, wherein the closure includes various advantageous features not heretofore taught or contemplated by the prior art.

BRIEF SUMMARY OF THE INVENTION

According to broad aspects of one form of the present invention, a dispensing closure is provided for a system having an opening between an exterior of the system and an interior of the system where a fluent substance may be stored. The dispensing closure has a closure body that can be located at the system opening and that defines an inlet for communicating with the system. The closure body further has an upper end defining an aperture to accommodate the flow of a fluent substance through the closure body. The closure body includes a pair of abutments extending upwardly from the upper end.

The dispensing closure has a locking member mounted on the closure body for rotation about a central rotational axis. The locking member has an intermediate flow passage for accommodating the flow of a substance through the closure body aperture. The locking member has a locking position, and an unlocking position rotated about the central rotational axis away from the locking position.

The dispensing closure has an actuator that is rotatably mounted to the locking member for occluding the locking member intermediate flow passage to prevent flow of a fluent substance through the closure when the actuator is in a closed, non-dispensing position and for permitting flow of a fluent substance through the closure when the actuator is rotated to an open, dispensing position. The actuator includes a dispensing flow passage that is in communication with the intermediate flow passage of the locking member when the actuator is in the open, dispensing position. The actuator includes a pair of downwardly extending abutments for confronting the pair of upwardly extending abutments extending from the upper end of the closure body when the locking member is in the locking position to prevent the actuator from moving into the open, dispensing position.

In one aspect of the present invention, the closure body is adapted for use with a system that has the form of a container defining the opening and the closure body is one of: a separate structure for being attached to the container at the container opening; or an integral structure that is a unitary part of a container formed at the container opening.

In another form of the present invention, the actuator rotates about a pivot axis relative to the locking member and the dispensing flow passage of the actuator is located on one side of the pivot axis when viewed from above. The actuator includes a sloping back region which is located on another side of the pivot axis when viewed from above. The pair of abutments of the closure body are located beneath the sloping back region when the locking member is in its locking position.

In yet another form of the present invention, the closure body further includes a flexible wall surrounding and defining at least a portion of the aperture in the upper end of the closure body. The flexible wall is movable in a radial direction relative to the central rotational axis to seal against a portion of the locking member. In one preferred form, the flexible wall includes a proximal end connected the upper end of the closure body and a cantilevered, distal end extending axially inwardly from the proximal end toward the container interior. The distal end includes a radially inwardly extending sealing face. In another preferred form, the closure body includes an annular recess located between the upper end and the flexible wall to permit substantial radial deflection of the flexible wall to maintain a fluid tight seal and/or to reduce or minimize the rotational torque required of a user in order to move the locking member between its unlocking and locking positions atop the closure body.

In one aspect of the present invention, the locking member defines a pivot axis about which the actuator rotates relative to the locking member and the locking member further defines a central bisecting axis that is normal to the pivot axis. The locking member further includes a post extending upwardly therefrom and located generally along the central bisecting axis.

According to another form of the present invention, the locking member includes a bottom deck defining an aperture, and the pair of upwardly extending abutments of the closure body extend through such an aperture. In one preferred form, the locking member defines a pivot axis about which the actuator rotates relative to the locking member and the locking member further defines a central bisecting axis that is normal to the pivot axis. The pivot axis and the central bisecting axis divide the locking member into four quadrants when viewed from above, and the aperture accommodating the pair of upwardly extending abutments itself extends between two of the four quadrants.

According to another aspect of the present invention, the upwardly extending abutments of the closure body each have an identical radius of curvature centered on the central rotational axis, and each one of the downwardly extending abutments of the actuator has a length extending at an oblique angle relative to the radius of curvature with the locking member in its locking position.

In one form of the invention, the closure body has a plurality of circumferentially spaced retaining projections extending upwardly from the closure body upper end, and the locking member has a plurality of arcuate slots therein, each one for receiving a different one of the retaining projections. In one preferred form, the locking member includes a bottom deck defining an aperture and the pair of abutments of the closure body extend upwardly through the aperture, and the aperture is connected to one of the arcuate slots in the locking member.

In still another aspect of the present invention, the end of the closure body has an upper surface with at least one recess therein. The locking member has at least one resilient projection having a bead. Rotation of the locking member relative to the closure body carries the projection in an arc with the bead engaging the surface so that the projection is deflected by the surface. Continued rotation of the locking member relative to the closure body carries the projection to a location in which the at least one recess receives the bead, whereupon the projection returns to its undeflected condition as the bead snaps into the at least one recess to generate at least an audible signal and/or a tactile signal.

In another aspect of the present invention, the closure body has at least one indicium, and the locking member has at least one indicium that cooperate to indicate whether the locking member is in one of the locking position or the unlocking position.

In still another form of the present invention, the locking member is rotatable less than 45 degrees about the central rotational axis between the locking position and the unlocking position.

According to another form of the present invention, the actuator includes a pair of oppositely extending protrusions, and the locking member includes an outer wall having a pair of facing recesses therein to each receive a different one of the protrusions.

In another aspect of the present invention, the locking member includes a raised central deck and a spout extending upwardly from the raised central deck. The intermediate flow passage of the locking member extends through the raised central deck and the spout.

According to another form of the present invention, the dispensing closure is in combination with a system that is a container of a fluent substance. The closure and container together defining a package.

It should be appreciated that the invention may include any or all of the above-described features, include only one of the above features, more than one of the above features, and any combination of the above features. Furthermore, other objects, features and advantages of the invention will become apparent from a review of the entire specification including the appended claims and drawings.

BRIEF DESCRIPTION OF THE DRAWINGS

In the accompanying drawings forming part of the specification, in which like numerals are employed to designate like parts throughout the same.

FIG. 3 shows the closure oriented about 100 degrees from the orientation in FIG. 1 so as to show a "rear" region of the closure which is only partially visible in FIG. 1, and FIG. 3 further shows the locking member of the closure oriented in a locking or locked position;

FIG. 7 shows the closure in a locking or locked position;

DESCRIPTION OF THE PREFERRED EMBODIMENT

Figure 1:
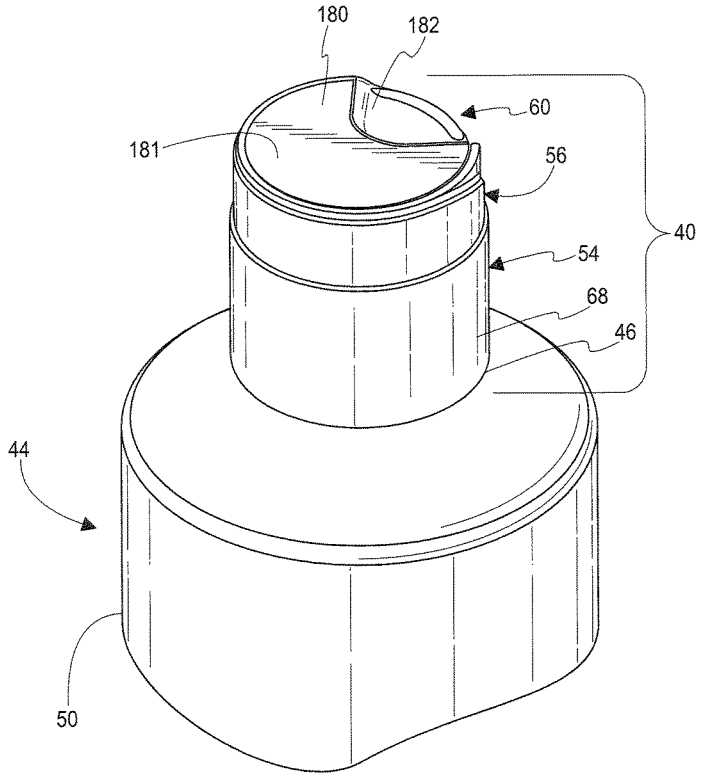
FIG. 1 is an isometric view, taken from above, of an embodiment of a dispensing closure of the present invention shown installed at the opening of a container wherein only a fragmentary, upper portion of the container is illustrated in FIG. 1.

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

For ease of description, many figures illustrating the invention show an embodiment in the typical orientation that the closure would have at the opening of a system that is a container in the form of an upright bottle, and terms such as "inward", "outward", "upper", "lower", "axial", "radial", "lateral", etc., are used with reference to this orientation. The terms "axial" and "radial" are used with respect to a central rotational axis or axis "A" (FIG. 2), generally defined as the axis of rotation about which a locking component of the closure rotates as discussed in greater detail hereinafter. The phrase "axially inwardly" refers to the direction along the central rotational axis "A" toward the bottom of the closure and toward the container interior. The phrase "axially outwardly" refers to the opposite direction along the central rotational axis "A" toward the top of the closure and away from the container interior. The phrase "radially inwardly" refers to the direction normal to, and toward, the central rotational axis "A". The phrase "radially outwardly" refers to the direction normal to, and away from, the central rotational axis "A". It will be understood, however, that the closure of this invention may be manufactured, stored, transported, used, and sold in an orientation other than the orientation described.

The dispensing closure, or simply referred to herein as a "closure", of this invention is especially suitable for use with, among other things, a variety of conventional or special systems, including containers, the details of which, although not fully illustrated or described, would be apparent to those having skill in the art and an understanding of such containers. The particular container, per se, that is illustrated and described herein forms no part of, and therefore is not intended to limit, the broadest forms of the present invention. It will also be understood by those of ordinary skill that novel and non-obvious inventive aspects are embodied in the described exemplary closures alone.

The closures described herein are especially suitable for use on a container that contains a fluent material or substance in the form of a lotion or cream that can be dispensed, or otherwise discharged, from the container through the opened closure. Such fluent substances may be, for example, a personal care product, a food product, an industrial product, a household product, or other types of products. Such substances may be for internal or external use by humans or animals, or for other uses (e.g., activities involving medicine, manufacturing, commercial or household maintenance, construction, agriculture, etc.).

An embodiment of a closure of the present invention, and the components thereof, are illustrated in FIGS. 1-24, wherein the closure is designated generally by the reference number 40. In the illustrated embodiment, the closure 40 is provided in the form of a separate article which is configured to be attached or assembled to a system such as a container 44 (visible in FIG. 1 only) that would typically contain a fluent substance.

The container 44 may be any conventional type, such as a collapsible, flexible pouch, or may be a generally rigid structure that has somewhat flexible, resilient walls, such as a bottle or tank. FIG. 1 shows an embodiment of the closure 40 attached to a container 44 that is a generally rigid bottle having a wall that is somewhat flexible and that can be squeezed by the user to dispense a product when the closure 40 is opened. The closure 40 may instead be used on a larger dispensing system (not illustrated) which may include, or be part of, for example, a medical device, processing machine, dispenser, reservoir on a machine, etc., wherein the system has an opening to the system interior.

The container 44, or a portion thereof, may be made from a material suitable for the intended application (e.g., a thin, flexible material for a pouch, wherein such a material could be a polyethylene terephthalate (PET) film or a polyethylene film and/or an aluminum foil, or a thicker, less flexible material such as molded polyethylene or polypropylene for a more rigid container 44 such as a bottle).

In applications wherein the closure 40 is mounted to a container 44 such as a bottle or pouch (not illustrated), it is contemplated that typically, after the closure manufacturer would make the closure (e.g., by molding parts of the closure 40 from a thermoplastic polymer and assembling them), the closure manufacturer will then ship the closure 40 to a container filler facility at another location where the container 44 is either manufactured or otherwise provided, and where the container 44 is filled with a product prior to installation of the closure. If the container is a collapsible pouch, then the closure may include a suitable fitment portion that can be attached to the pouch as the pouch is being made and filled, or as the pouch is being made but before the pouch is subsequently filled through the open closure or through open regions of the pouch walls that are later sealed closed.

In the illustrated embodiment of the closure 40, the closure 40 is provided as a separately manufactured article, component, or unit for being screwed onto the container 44. It will be appreciated, however, that in some applications, it may be desirable for the closure 40 to be attached to a container in a manner that would not allow a user to easily remove the closure 40. Further, it may be desirable for the closure (or at least the body of the closure) to be formed as a unitary part, or extension, of the container (e.g., a bottle) wherein such a unitary part or extension also (i.e., simultaneously) defines an end structure of the container, per se.

With reference to FIG. 1, where the illustrated container 44 is a bottle, the bottle typically includes an upper end portion 46 (or other suitable structure on some part of the bottle) that defines the bottle mouth or opening and a threaded portion (or snap-fit bead, not illustrated) for mating with a cooperating threaded portion (or snap-fit bead, not illustrated) of the closure 40, which is discussed in detail hereinafter. The bottle upper end portion 46 typically has a cross-sectional configuration with which the closure 40 is adapted to engage. Extending from the upper end portion 46 is a main body portion 50 of the bottle. The main body portion 50 has a cross-sectional configuration that differs from the cross-sectional configuration of the bottle upper end portion 46 at the bottle opening. In other types of bottles, the bottle may instead have a substantially uniform shape along its entire length or height without any portion of reduced size or different cross-section.

The embodiment of the closure 40 illustrated in the FIGS. 1-24 is especially suitable for use with a container 44 that is a bottle having a substantially flexible wall or walls that can be squeezed or deflected laterally inwardly by the user to increase the internal pressure within the bottle so as to force the fluent substance out of the bottle and through the opened closure 40. The walls have sufficient, inherent resiliency so that when the squeezing forces are removed, the bottle walls return to the normal, unstressed shape.

In other applications it may be desirable to employ a generally rigid container, and to pressurize the container interior at selected times with a piston or other pressurizing system (not illustrated), or to reduce the exterior ambient pressure so as to suck the material out through the open closure.

In some other applications, the closure 40 may be used with a product containment system or other type of system (not illustrated), where the closure 40 can function to permit or prevent the egress or ingress of substances relative to the system in which the closure 40 is installed.

For example, in some applications it may be desirable to also accommodate filling or refilling of the container 44 (or other system) with the fluent contents through the opened closure 40 into the container 44.

Figure 2:
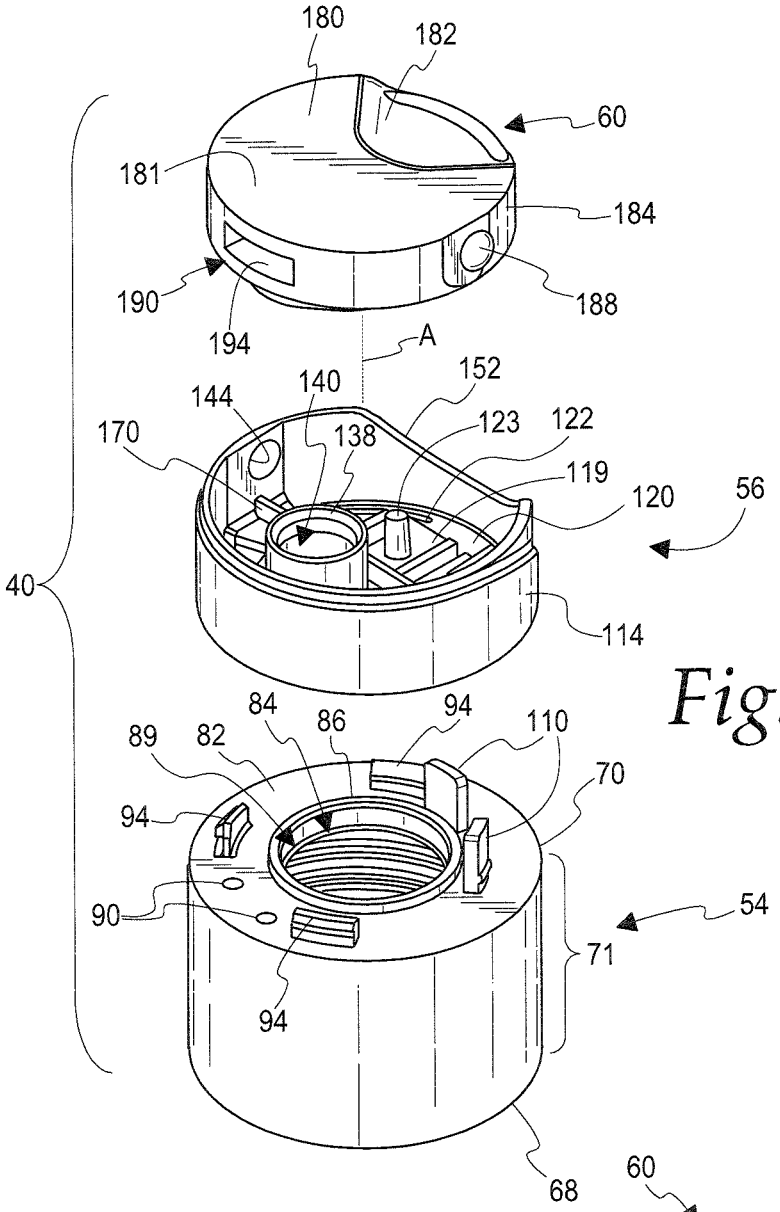
FIG. 2 is an exploded, isometric view of the closure illustrated in FIG. 1.
Figure 3:
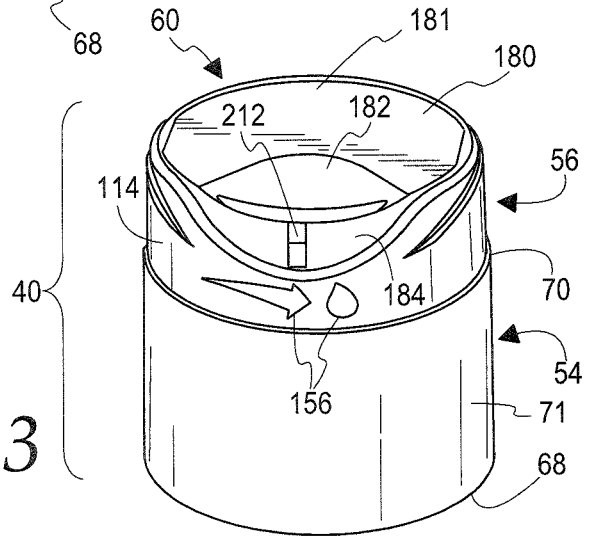
FIG. 3 is an isometric view, taken from above, of the closure illustrated in FIG. 1.
Figure 4:
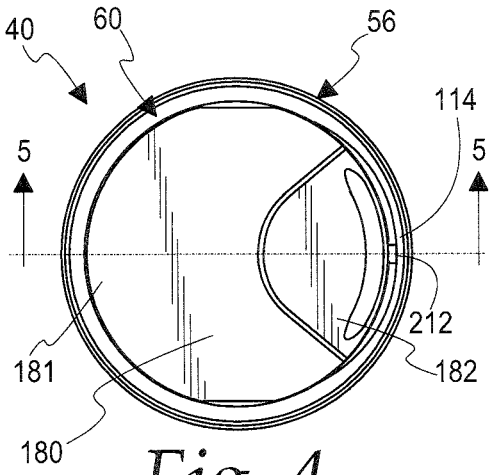
FIG. 4 is a top plan view of the closure illustrated in FIG. 1.

With reference to FIG. 2, the closure 40 includes the following basic components: a base or closure body 54, a twist collar or locking member 56, and an actuator 60. An optional cap or lid (not illustrated) could be provided for being removably mounted atop of the closure 40. The closure body 54, the locking member 56, and the actuator 60 are preferably formed or molded as separate structures and subsequently assembled together. The closure body 54, the locking member 56, and the actuator 60 are each preferably molded from a suitable thermoplastic material such as polyethylene or polypropylene. Other materials may be employed instead. It will be understood that in alternative designs (not illustrated), two or more of the three basic components may be unitarily formed or molded together initially as one connected structure, and then substantially broken apart, and then assembled in an operative combination. Further, it will be understood that the closure body 54 may be unitarily formed or molded as an extension of the upper end of the container 44.

Figure 7:
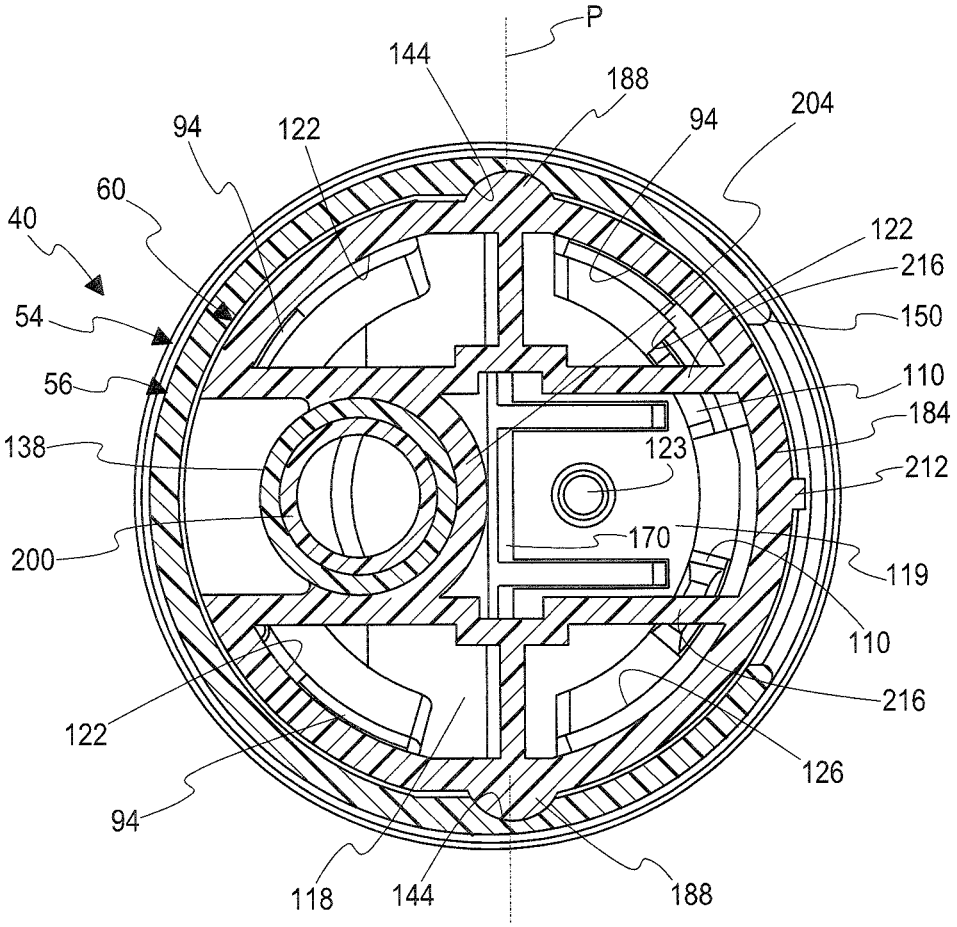
FIG. 7 is a cross-sectional view of the closure illustrated in FIG. 1, taken generally along the plane 7-7 in FIG. 6.
Figure 8:
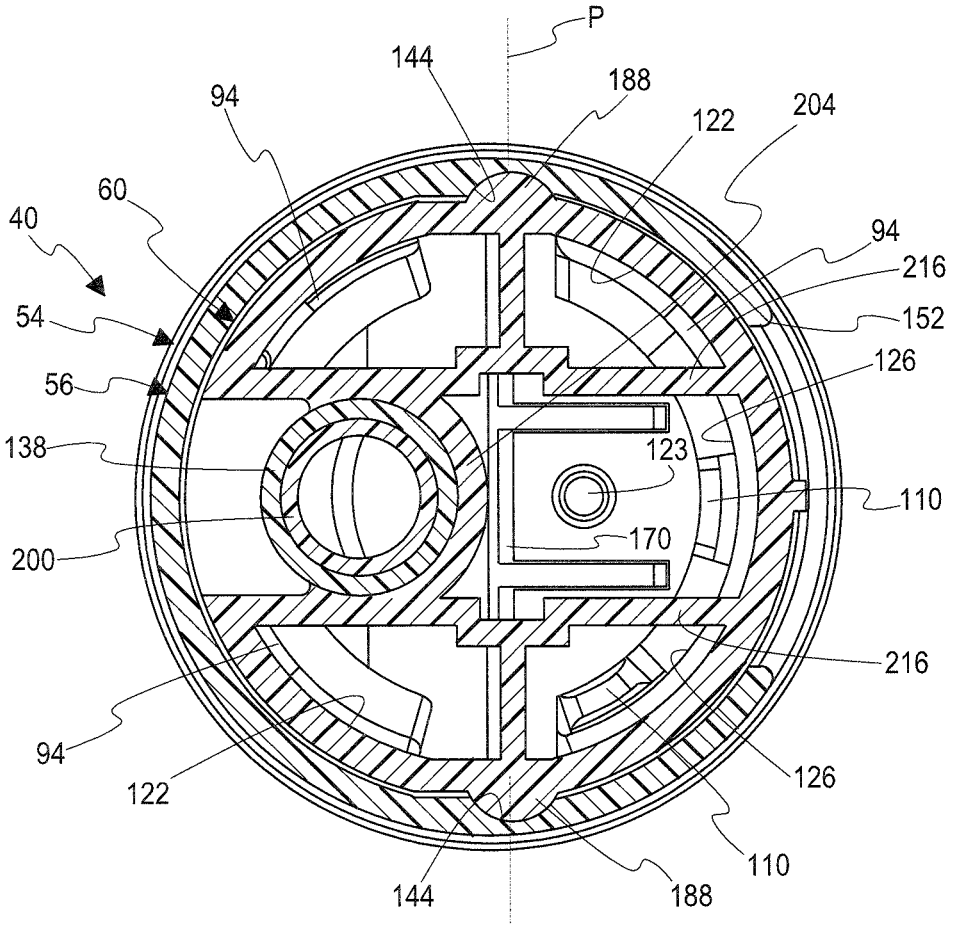
FIG. 8 is a cross-sectional view of the closure similar to FIG. 7, however in FIG. 8 the locking member has been rotated counterclockwise relative to the closure body into an unlocked position.

The actuator 60 is movable between an open position (FIG. 9) and a closed position (FIG. 1), and the actuator 60 can be "locked" in the closed position when the locking member 56 is rotated to a locking position (FIG. 7) away from an unlocking position (FIG. 8).

Figure 5:
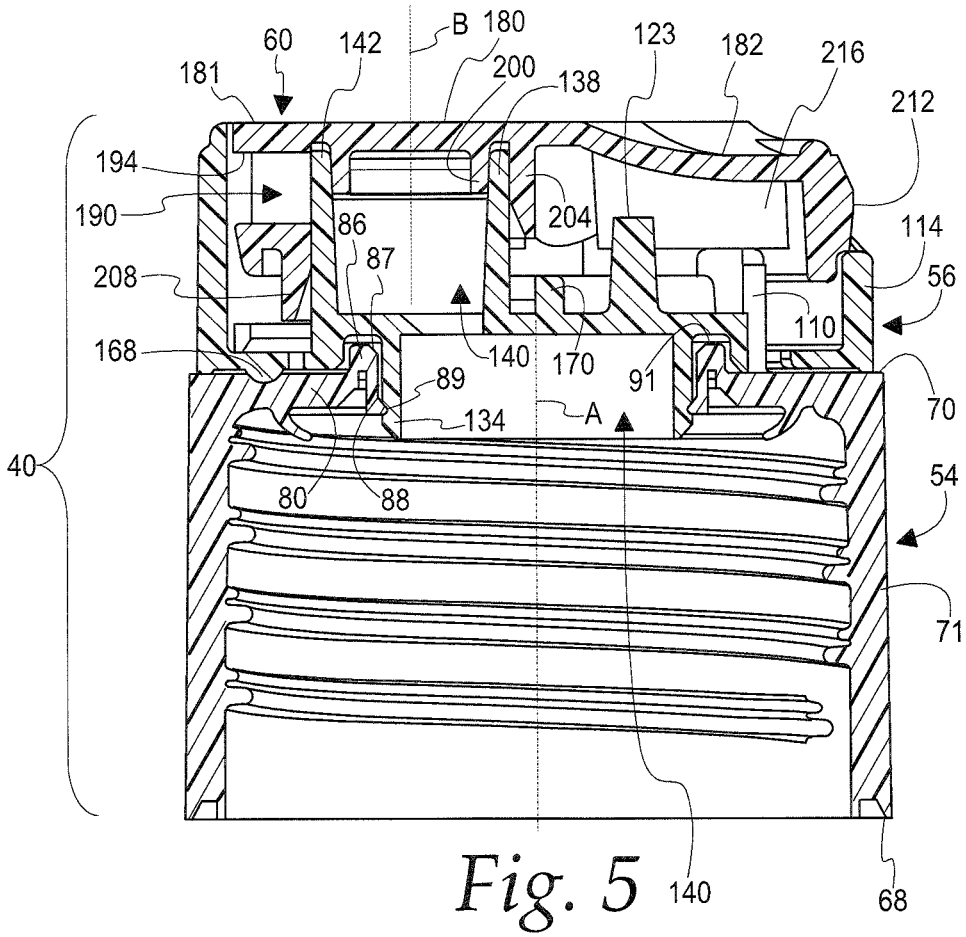
FIG. 5 is a cross-sectional view of the closure illustrated in FIG. 1, taken generally along the plane 5-5 in FIG. 4.
Figure 6:
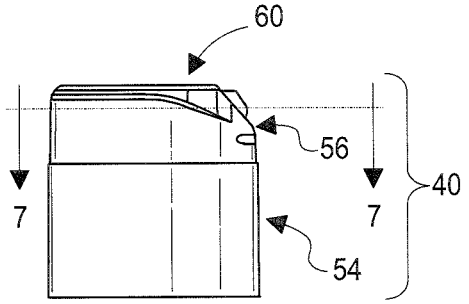
FIG. 6 is a side elevation view of the closure illustrated in FIG. 1.
Figure 22:
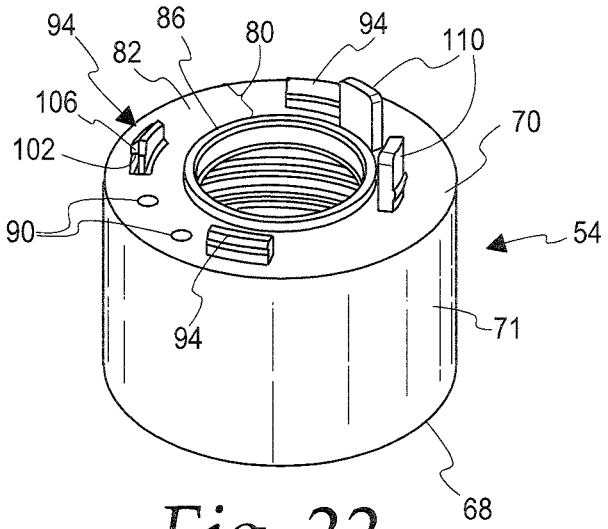
FIG. 22 is an isometric view, taken from above, of the closure body of the dispensing closure illustrated in FIG. 2.
Figure 24:
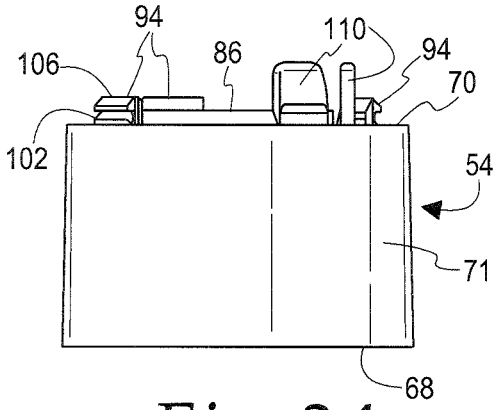
FIG. 24 is a right side elevation view of the closure body shown in FIG. 2.

Referring now to FIGS. 5, 22, and 24, the closure body 54 includes an inlet portion or lower end 68 and an upper end 70. A cylindrical skirt or outer wall 71 extends between the lower end 68 and the upper end 70. The lower end 68 defines an inlet or passage 74 (visible in FIG. 10) for being located at the opening of the bottle 44 (FIG. 1) to communicate with an interior of the bottle 44 containing a fluent substance. Indicia may be located on the outer wall 71, proximal or near the upper end 70, which function together with indicia located on the locking member 56 to indicate relative rotation between the closure body 54 and the locking member 56 about the central rotation axis "A" (FIG. 5), as will be discussed in detail below.

Referring to FIG. 5, the interior of the closure body 54 is provided with a plurality of internal or female threads extending radially inwardly from the outer wall 71. The internal threads cooperate with, and threadingly engage, mating external or male threads located on the exterior of the container (not visible in FIG. 1) to securely attach the closure body 54 together with the container 44 (FIG. 1) at the opening of the container 44. It will be appreciated that other conventional or special means of connecting the closure body 54 to the container 44 could be employed, such as mating snap-fit beads, bi-injection molding, adhesives, mechanical locks, spin welding of the closure to the container, etc.

If the closure body 54 is to be used on a flexible pouch (not illustrated), then it is presently contemplated that the closure body lower end 68 would have a suitable boat-shaped fitment configuration (e.g., such as the fitment body shown in PCT/US2013/043065, which is incorporated by reference herein in its entirety) for being sealed with the pouch, and most pouch manufacturers will prefer to install the closure body lower end at an opening formed in the pouch with heat sealing techniques or ultrasonic sealing techniques.

Figure 10:
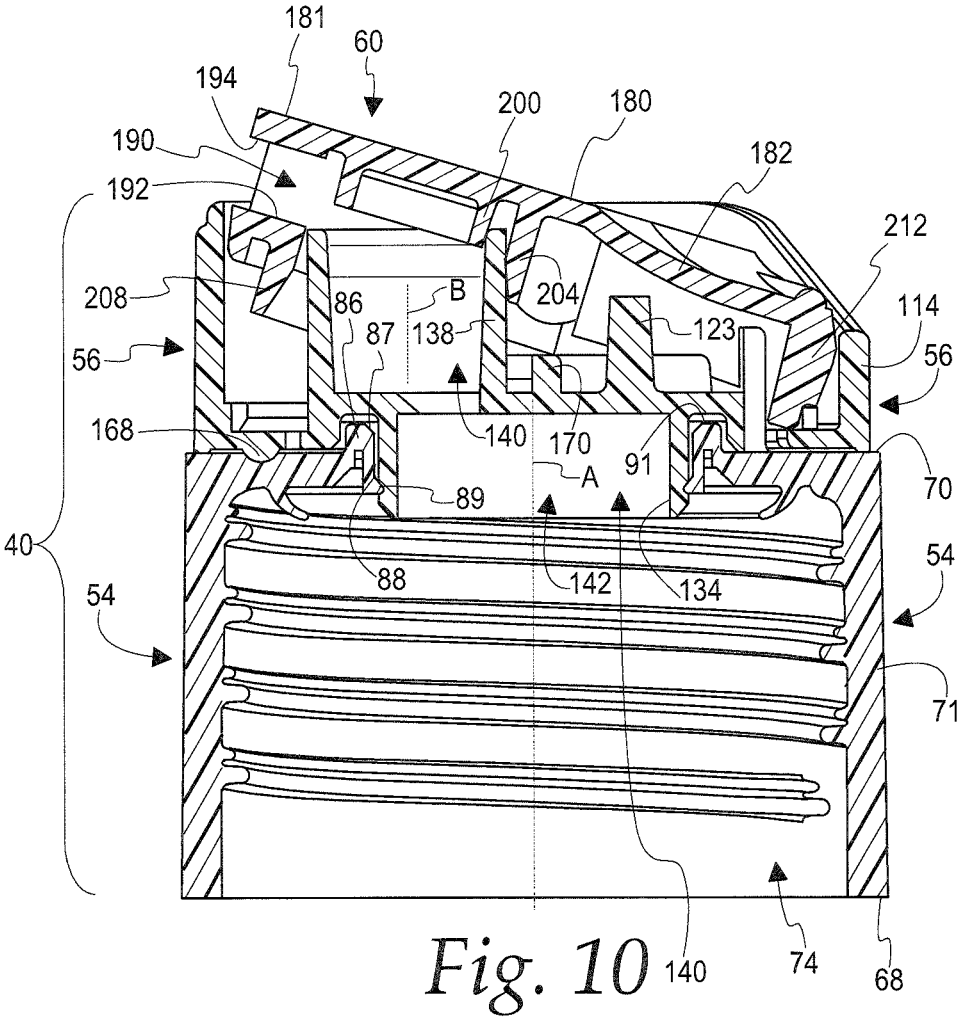
FIG. 10 is a cross-sectional view of the closure illustrated in FIG. 1, taken generally along the plane 10-10 in FIG. 9.
Figure 11:
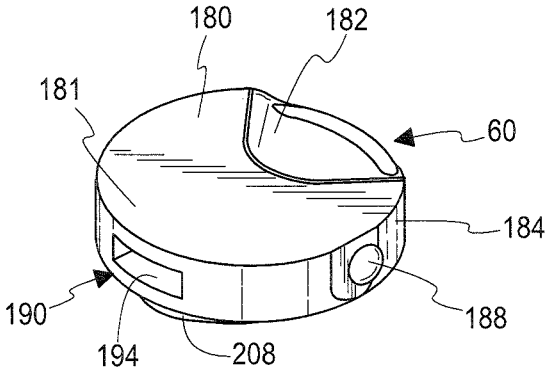
FIG. 11 is an isometric view, taken from above, of the actuator of the dispensing closure illustrated in FIG. 2.
Figure 23:
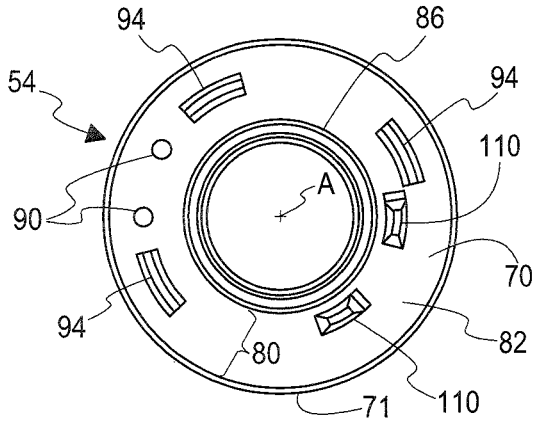
FIG. 23 is a top plan view of the closure body shown in FIG. 2.

Referring now particularly to FIGS. 22 and 23, the closure body wall 71 terminates at a top deck 80 at the upper end 70. The top deck 80 has an exterior surface or upper surface 82. The top deck 80 further has a circular, central hole or aperture 84 (FIG. 2). The aperture 84 opens to (i.e., communicates with) the interior of the closure body 54 which defines the inlet passage 74 (FIG. 11). With reference to FIGS. 5 and 10, the aperture 84 in the closure body deck 80 is defined in part by a flexible wall 86 that is movable in a radial direction relative to the central axis "A" to seal against a portion of the locking member 56. The flexible wall 86 includes a proximal end 87 connected to the upper end 70 of the closure body 54 and a cantilevered, distal end 88 which extends axially inwardly from the proximal end 87, relative to the central axis "A" (toward the container interior). The distal end 88 includes a radially inwardly extending sealing face 89 for contacting against a plug seal or annular wall of the locking member 56, the details of which are discussed below. An annular recess or channel 91 is formed between the connection point of the upper end 70 and the flexible wall 86 to permit sufficient radial deflection of the flexible wall 86 when engaged by the relatively more rigid locking member 56. The recess 91 permits the flexible wall 86 to maintain a sufficient seal around the locking member 56 while reducing the resistance or frictional torque required of the user to move the locking member 56 relative to the body 54 between the locking and unlocking positions as compared to other sealing structures that might be used—such as a rigid annular sealing bead between these mating parts.

While the closure body 54 is illustrated as having a generally cylindrical structure, it will be appreciated, however, that the closure body 54 may take a variety of forms and need not be limited to a cylindrical shape and need not have circular cross-sections as shown. For example, the lower end 68 and/or the upper end 70 may be elliptical, polygonal, or some irregular shape.

Referring to FIGS. 2 and 22, the upper surface 82 of the top deck 80 is provided with a pair of hemispherical recesses 90 therein, which are spaced apart along a circumference centered on the central rotational axis "A". The hemispherical recesses 90 accommodate a mating protrusion on the locking member 56 discussed hereinafter to generate or produce an audible and/or tactile indication to a user of the closure 40 when the locking member 56 is rotated with respect to the closure body 54. Three generally arcuate lugs or retaining projections 94 are circumferentially spaced apart and extend upwardly from the upper surface 82. As discussed hereinafter, the three retaining projections 94 fit into mating arcuate slots within the locking member 56 to retain or hold the locking member 56 to the closure body 54. As best shown in FIGS. 22 and 24, each one of the retaining projections 94 terminates in a radially-outwardly extending flange defining a flat lower surface 102 and a frusto-conical, sloping upper surface 106, the function of which will be discussed in detail hereinafter.

While three retaining projections 94 are provided for mating with (i.e., being received in) three arcuate slots in the locking member 56 in the illustrated embodiment of the closure 40, it will be understood that a greater or fewer number of retaining projections 94 and mating slots may be provided to either increase or decrease, respectively, the rigidity of the connection holding together the locking member 56 to the closure body 54.

With reference to FIGS. 23-24, the closure body 54 is further provided with a pair of arcuate locking tabs or abutments 110 extending upwardly from the upper surface 82 of the top deck 80. The abutments 110 serve to contact a pair of mating features of the actuator 60 to prevent the actuator 60 from moving into an open, dispensing position when the locking member 56 is in a locking position as will be discussed below. The abutments 110 extend axially outwardly beyond the three retaining projections 94, and they each extend through a single, unique, larger arcuate aperture within the locking member 56 as discussed hereinafter.

As can be seen in FIG. 23, when the closure body 54 is viewed from above, the radially innermost portion of each retaining projection 94 defines an arc of a circle, and the radially innermost portion of the abutments 110 define an arc of a circle. The interior radius of curvature of each abutment 110 is less than the interior radius of curvature of each of the three retaining projections 94. Furthermore, it can be seen in FIG. 23 that each one of the three retaining projections 94 and the abutments 110 lie within a different quadrant of the closure body 54, when the closure body 54 is viewed from above. The shorter radius of curvature of the abutments 110 assists in preventing undesirable interference between the abutments 110 and the actuator 60 when the locking member 56 is rotated into the unlocked position, as will be discussed in detail hereinafter.

Figure 18:
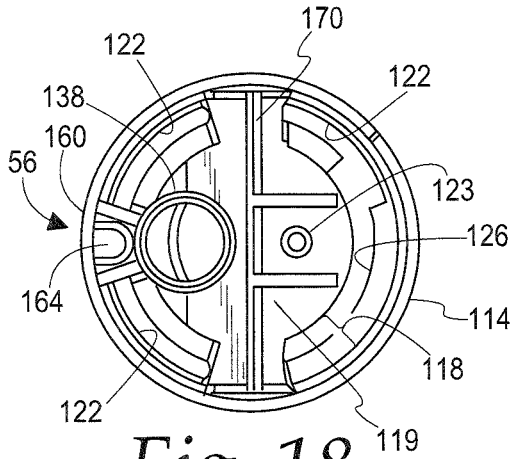
FIG. 18 is a top plan view of the locking member shown in FIG. 2.

With reference to FIGS. 16-21, the locking member 56 is generally ring-shaped and has an annular, outer wall 114, a generally circular, bottom deck 118 that extends radially inwardly from the bottom portion of the outer wall 114, and a raised central deck 119 (FIG. 18). The bottom deck 118 of the locking member 56 defines a top surface 120 (FIG. 16) facing toward the actuator 60 (FIG. 2) and a bottom surface 121 (FIG. 17) facing toward the closure body 54 (FIG. 2). The bottom deck 118 is further provided with three arcuate retention slots 122 therein. Each slot 122 receives a separate one of the closure body retaining projections 94 (FIG. 2). When the locking member 56 is assembled together with the closure body 54, the projections 94 extend through the slots 122 such that the lower surface 102 of each locking projection flange extends radially outwardly over, and confronts, the upper surface 120 of the locking member bottom deck 118.

Figure 19:
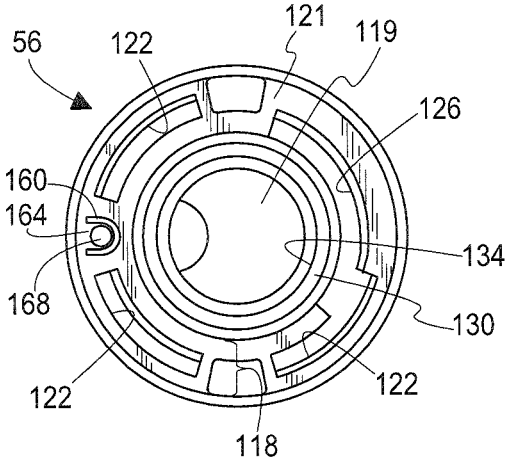
FIG. 19 is a bottom plan view of the locking member shown in FIG. 2.
Figure 17:
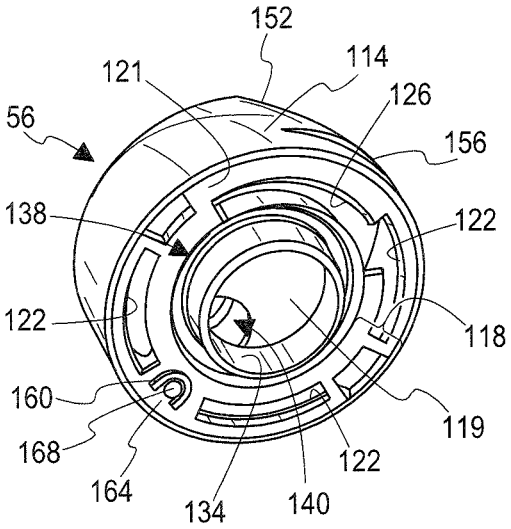
FIG. 17 is an isometric view, taken from below, of the locking member illustrated in FIG. 2.

With reference to FIGS. 17, 18, and 19, the bottom deck 118 of the locking member 56 is further provided with an arcuate aperture 126 to receive both of the abutments 110 (FIG. 5) when the locking member 56 is assembled together with the closure body 54 (FIG. 5). The shape of the aperture 126 accommodates the travel of the pair of abutments 110 though an arc of about 30 degrees, with respect to axis "A", when the locking member 56 is rotated relative to the closure body 54 between a locking position (FIG. 7) and an unlocking position (FIG. 8). The aperture 126 is larger than the slots 122 to ensure proper assembly of the locking member 56 together with the closure body 54, and the aperture 126 extends between two quadrants of the locking member 56. The aperture 126 further connects with, or opens to, one of the slots 122. The connection of the aperture 126 with one of the slots 122 may permit the closure 40 to utilize less material, thus advantageously reducing weight, and may further improve the ease of manufacturing the closure 40 by avoiding substantially thin walled portions of the locking member 56 that may be prone to breaking during shipping or handling.

As can be seen in FIG. 19, radially inwardly of the bottom deck 118 of the locking member 56 there is an annular recess or channel 130 which surrounds a downwardly-extending central plug or annular wall 134. When the locking member 56 is assembled together with the closure body 54 (FIG. 5), the annular channel 130 functions to receive the flexible wall 86 (FIG. 5) of the closure body 54 while the annular wall 134 of the locking member 56 fits within the flow aperture 84 (FIG. 2) defined by the closure body 54. As illustrated in FIG. 5, the locking member annular wall 134 engages the sealing face 89 to radially outwardly deflect the wall 86 and to establish a liquid-tight, sliding seal with the locking member 56. The wall 134 is provided with a tapered end surface 136 (FIGS. 20 and 21) to assist in seating of the wall 134 within the aperture 84 during assembly of the components by the manufacturer.

Figure 16:
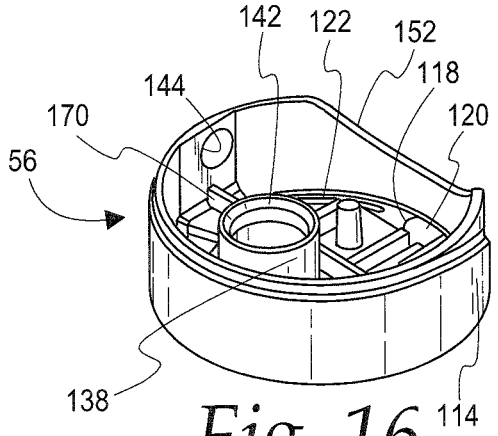
FIG. 16 is an isometric view, taken from above, of the locking member of the dispensing closure illustrated in FIG. 2.

With reference to FIG. 16, the locking member 56 includes a cylindrical spout 138 that extends upwardly from the deck 118. The upwardly extending spout 138 and the downwardly extending annular wall 134 together define an intermediate flow passage 140 (FIG. 17) that extends through both the spout 138 and the wall 134. The spout 138 is centered on an axis "B" (FIGS. 5 and 10) that is offset from the central axis "A" about which the wall 134 is centered. As will be discussed in detail hereinafter, the fluent substance flows from the outlet end of the container 44 within the inlet passage 74 of the closure body 54 (FIG. 5), through the closure body 54, and into the locking member 56 through the intermediate flow passage 140.

As shown in FIG. 16, the inside of the annular wall 114 of the locking member 56 is provided with a pair of opposing detents or hemispherical recesses 144 that serve to retain mating hemispherical protrusions or trunnions formed on oppositely-facing sides of the actuator 60 as discussed in detail below.

Figure 20:
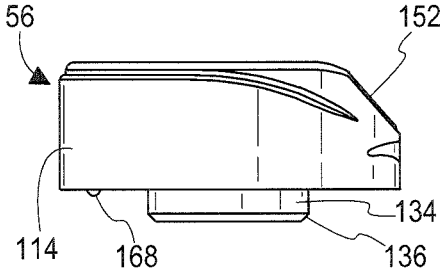
FIG. 20 is a right side elevation view of the locking member shown in FIG. 2.

As can be seen in FIGS. 16 and 20, a rear portion of the wall 114 includes a cut-away or recessed area 152 to accommodate a user's finger (e.g., thumb or forefinger) during actuation of the actuator 60, as will be discussed herein.

Figure 21:
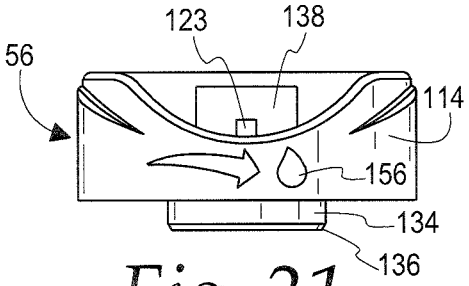
FIG. 21 is a rear elevation view of the locking member shown in FIG. 2.

With reference to FIG. 21, the annular wall 114 of the locking member 56 has indicia 156 in the form of an arrow pointing toward a fluid droplet to indicate the direction in which the locking member 56 must be turned relative to the body 54 to place the locking member in the unlocked position form the locked position.

As can be seen in FIG. 19, a U-shaped cut aperture or through hole 160 is provided within the annular bottom deck 118 to define a radially-inwardly extending projection 164. The projection 164 has a downwardly-extending bump or hemispherical bead 168 formed thereon. During relative rotation between the locking member 56 and the closure body 54 about central rotational axis "A", the bead 168 moves with respect to the closure body recesses 90 (FIG. 22) to produce an audible and/or tactile signal for the user of the closure 40. The particular details of operation of this audible and/or tactile signal mechanism are discussed hereinafter.

Referring to FIG. 18, the locking member 56 includes a central rib 170 that bisects the locking member 56 when viewed from above. The central rib 170 extends between opposite sides of the annular wall 114, beneath the hemispherical recesses 144 (FIG. 2). The central rib 170 strengthens the locking member 56 and also functions to support the actuator 60 during pivoting movement of the actuator 60 with respect to the locking member 56, and to prevent undesirable vertical movement of the locking member 56 with respect to the actuator 60 during pivoting thereof, as will be discussed in detail hereinafter. The locking member 56 defines a pivot axis "P" (FIGS. 7 and 8) about which the actuator 60 may pivot with respect to the locking member 56, the operation of which is discussed hereinafter. The locking member 56 further defines a central bisecting axis that is normal to the pivot axis "P", wherein the pivot axis "P" and the central bisecting axis divide the locking member 56 into four quadrants. The aperture 126 extends between two of the four quadrants. The locking member 56 may advantageously include a post 123 extending upwardly therefrom and being located generally on the central bisecting axis for efficient formation or molding of the features near the aperture 126 and recesses 122.

As shown in FIGS. 11-15, the actuator 60 has a generally disc-like shape with a substantially flat top end 180 with a front region 181 and a recessed or sloping back region 182 designed to accommodate the finger of a user of the closure 40 during opening of the actuator 60. The actuator 60 has an annular side wall 184 with a pair of semispherical protrusions 188 spaced 180 degrees apart from one another. Each one of the protrusions 188 fits within one of the recesses 144 (FIGS. 7 and 8) in the locking member 56.

Figure 12:
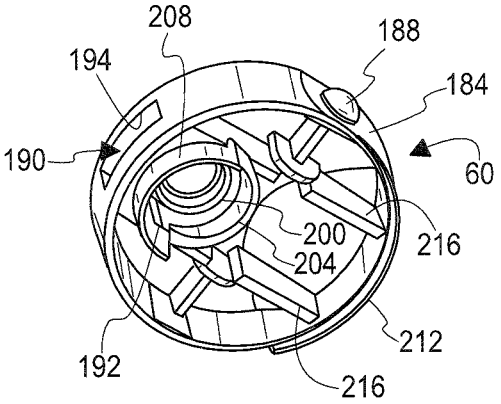
FIG. 12 is an isometric view, taken from below, of the actuator of the dispensing closure illustrated in FIG. 2.

As illustrated in FIGS. 11 and 12, the actuator 60 is provided with a dispensing flow passage 190 having an inlet end 192 (FIG. 12) and an outlet end 194 on the exterior of the actuator 60. The actuator dispensing flow passage 190 may be selectively placed into communication with the intermediate flow passage 140 (FIG. 10) of the locking member 56 (FIG. 10) when the actuator 60 is pivoted from a closed position (FIG. 5) to an open position (FIG. 10) by a user of the closure 40. The actuator 60 has a plug or internal annular wall 200 that extends downwardly therefrom to seal against the inside of the spout 138 (FIG. 5) when the actuator 60 is in the closed position (FIG. 5). A first semi-circular sealing rim 204 and a second semi-circular sealing rim 208 extend downwardly in the actuator 60 to maintain a fluid tight seal between the locking member spout 138 and the actuator 60 such that the outlet end 194 of the dispensing flow passage 190 is the only path of egress for a fluent substance when the actuator 60 is in the open position.

Figure 13:
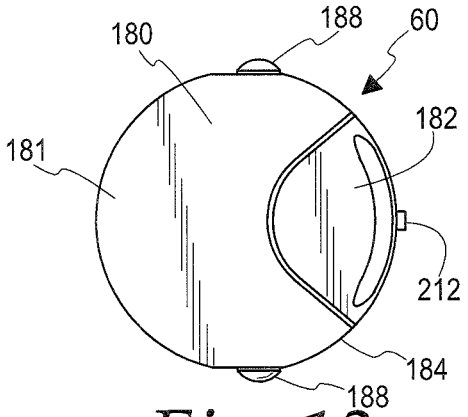
FIG. 13 is a top plan view of the actuator shown in FIG. 2.
Figure 15:
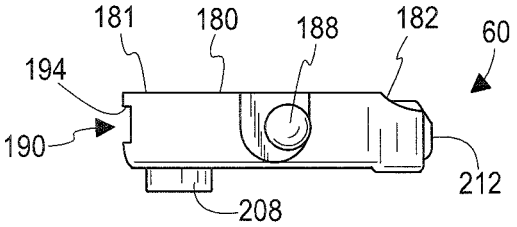
FIG. 15 is a right side elevation view of the actuator shown in FIG. 2.
Figure 14:
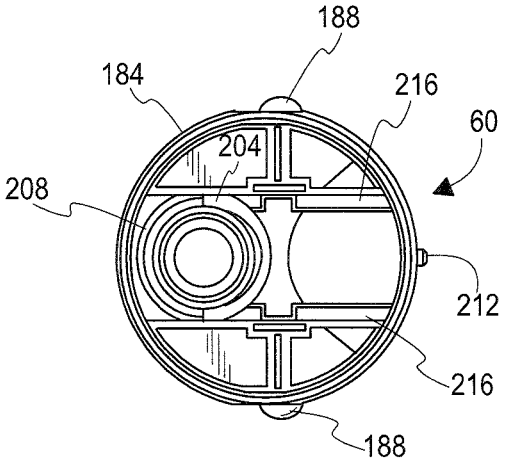
FIG. 14 is a bottom plan view of the actuator shown in FIG. 2.

With reference to FIGS. 13, 15, and 14, the annular side wall 184 of the actuator 60 has a wedge-shaped projection or cam element 212 extending therefrom. As shown in FIGS. 8 and 11, the cam element 212 is located at the back (i.e., rear) end of the actuator 60 adjacent the sloping back region 182 and functions to frictionally engage the inside of the locking member annular wall 114. The frictional engagement of the cam element 212 with the locking member wall 114 functions to stabilize the actuator 60 to maintain the actuator 60 in both the open and closed positions with respect to the locking member 56 after the user has pivoted the actuator 60 to the desired open or closed position.

As shown in FIGS. 12 and 14, the actuator 60, which is carried by the rotatable locking member 56, has a pair of ribs or abutments 216 extending downwardly from the underside of the top end 180. When the locking member 56 is in the locking position relative to closure body 54 (FIG. 7), each one of the two abutments 216 of the actuator 60 is located directly above one of the two abutments 110 of the closure body 54. In the locking position of the locking member 56, the upwardly-extending abutments 110 of the closure body 54 prevent any appreciable downward movement of the back end of the actuator 60 (as best illustrated in FIG. 7) to prevent a user of the closure 40 from placing the actuator 60 into the open position. When the locking member 56 is rotated into the unlocking position (FIG. 8), about 30 degrees away from the locked position, the pair of abutments 216 of the actuator 60 are no longer located directly above the pair of abutments 110 of the closure body 54. When the locking member 56, and the actuator 60 carried therein, are in the unlocking position, the upwardly-extending abutments 110 of the closure body 54 are no longer in the downward path of the abutments or ribs 216 of the actuator 60 so that the actuator 60 can be pivoted into the open position by a user of the closure 40, as discussed fully hereinafter.

One method of assembling the components of the closure 40 is next discussed with initial reference to FIG. 2. It will be understood that the method of assembly described herein is illustrative only, and there may be other methods of assembling the components of the closure 40. The actuator 60 and the locking member 56 may be assembled by first orienting the recesses 144 in the annular wall 114 of the locking member 56 with the hemispherical projections 188 of the actuator 60 such that the sloping back region 182 of the actuator 60 is located proximal to the recessed area 152 of the wall 114. The actuator 60 and locking member 56 may be subsequently brought together along axis "A" until the hemispherical projections 188 are pressed into the two the recesses 144, such that the actuator 60 is oriented in the closed, non-dispensing position. As can be seen in FIG. 5, the plug 200 of the actuator 60 seals against the inside of the spout 138 when the actuator 60 is assembled with the locking member 56 and oriented in the non-dispensing, closed position. One or both of the components of the locking member 56 and actuator 60 are sufficiently resilient to accommodate the assembly of the two components.

With reference to FIG. 2, the subassembly of the actuator 60 and locking member 56 may then be oriented adjacent the closure body 54 such that the aperture 126 in the bottom deck 118 of the locking member 56 overlies the abutments 110 of the closure body 54. In this orientation, each one of the arcuate slots 122 of the locking member 56 also overlies a respective one of the retaining projections 94 of the closure body 54. Then, with reference to FIG. 5, the closure body 54 and the subassembly of the actuator 60 and locking member 56 are pressed together along axis "A" such that the annular wall 134 of the locking member 56 sealingly engages the surface 89 on the flexible wall 86 of the closure body 54. As the subassembly of the actuator 60 and locking member 56 is brought together with the closure body 54, the flexible wall 86 of the closure body 54 is received within the channel 130 of the locking member 56. The abutments 110 extend through the aperture 126, followed by the deflection of the retaining projections 94 as they are snap-fit into the arcuate slots 122 to retain the closure body 54 together with the subassembly of the actuator 60 and locking member 56. While not illustrated, an additional snap-fit bead may be provided on a lower portion of the abutments 110 to improve the rigidity of the connection between the closure body 54 and the locking member 56. Alternatively, the locking member 56 and body 54 may be assembled initially as a subassembly, and then subsequently combined with the actuator 60.

The detailed operation and function of the closure 40 will next be described with initial reference to FIG. 1. Typically, a user will encounter the closure 40 as shown in FIG. 1, with the closure 40 installed upon the top end 46 of a container 44 of a fluent substance—the closure 40, container 44, and fluent substance within the container 44 together defining a package. A removable adhesive, tape, or plastic wrap (not illustrated) may optionally be provided over the top of the actuator 60 of the closure 40 for purposes of providing a redundant seal or tamper-evident feature. If such a seal or tamper evident feature is provided, the user would initially remove it from the closure 40 to expose the actuator 60 prior to initial operation of the closure 40.

The user would typically encounter the closure 40 as shown in FIGS. 3-7, whereby the locking member 56 is oriented in the locking position and the actuator 60 is oriented in the non-dispensing, closed position. In this position, the locking member bead 168, is received in one of the closure body recesses 90 (FIG. 5). When the locking member 56 is oriented in the locking position, the two abutments 216 of the actuator 60 are oriented to overlie, in a transverse orientation, the two abutments 110 of the closure body 54. At this stage in operation of the closure 40, if the user attempts to move the actuator 60 from the closed position into the open position (e.g., by depressing the sloping back region 182 of the actuator 60 to attempt to cause the actuator 60 to pivot within the recesses 144 of the locking member 56), then the user would be prevented from doing so by contact of the actuator abutments 216 with the closure body abutments 110. The initial locking configuration of the locking member 56 and the closed position of the actuator 60 prevents, or at least minimizes, the likelihood for accidental dispensing or spilling of the fluent substance if the package is accidentally inverted and/or perhaps accidentally impacted to create a slight increase in internal pressure. The inventor has found that the positioning of the pair of abutments 110 beneath the sloping back region 182 of the actuator 60 provides a more robust and stable blocking structure to prevent the actuator 60 from rotating about its pivot axis "P" compared to the prior art closures. For example, the inventor has found that some prior art closures having a disc-type actuator may be prone to slipping or popping out of engagement with the stationary portion of the closure (e.g., locking member 56 or closure body 54) when the actuator is sufficiently forced by a user or by impact during shipping or handling or during sufficiently high drop testing. It is believed that the provision of the pair of abutments 110, located on the same side of the pivot axis "P", at the rear of the actuator 60, functions to sufficiently counteract a torque developed between the actuator 60 and the stationary portion of the closure when the actuator is sufficiently forced by a user or by impact during shipping or handling to prevent or at least minimize the likelihood of the actuator 60 slipping or popping out of engagement with the stationary portion of the closure. It is further believed that the provision of the pair of abutments 110, located on either side of the bisecting axis (extending transverse to the pivot axis "P"), also functions to counteract a torque developed between the actuator 60 and the stationary portion of the closure 40 when the actuator is sufficiently forced by a user or by impact during shipping or handling to prevent or at least minimize the likelihood of the actuator 60 slipping or popping out of engagement with the stationary portion of the closure and thus providing a more tamper proof closure than those of the prior art.

With reference to FIG. 8, the user begins to open the closure 40 to the dispensing configuration by first grasping the locking member 56 by the outer wall 114, while holding the closure body 54 and/or the container 44 (FIG. 1 only), and then twisting or rotating the locking member 56 relative to the closure body 54 from the locking position into the unlocking position. The rotation is about the central rotational axis A (FIG. 2), and the angle of rotation is about 30 degrees for the particular component configuration illustrated in the figures. As can be seen by comparing FIG. 7 to FIG. 8, rotation of the locking member 56 from the locking position (FIG. 7) into the unlocking position (FIG. 8) moves the three locking member retention slots 122 along an arcuate path relative the closure body projections 94 received therein, and also moves the locking member aperture 126 in an arcuate path relative to the closure body abutments 110 received therein. Further, as the locking member 56 is rotated, the actuator 60 (which is mounted in the locking member 56) carries the abutments 216 to a moved position wherein neither of the abutments 216 is any longer located above the closure body abutments 110 (compare FIGS. 7 and 8).

When the user initially begins to twist or rotate the locking member 56 relative to the closure body 54 counterclockwise from the locking position toward the unlocking position, the locking member hemispherical bead 168 is urged out of a first one of the closure body recesses 90 as the radially-extending projection 164 flexes upwardly from the resulting interference. Continued rotation of the locking member 56 relative to the closure body 54 causes the hemispherical bead 168 to slide along an arcuate path on the upper surface 82 of the closure body top deck 80. When the locking member 56 is fully rotated into the unlocked position, then the hemispherical bead 168 snaps into the second one of the closure body recesses 90. Release of potential energy and movement of the radially-extending projection 164 to an unstressed condition results in an audible and/or tactile indication to the user that the closure 40 is unlocked.

Figure 9:
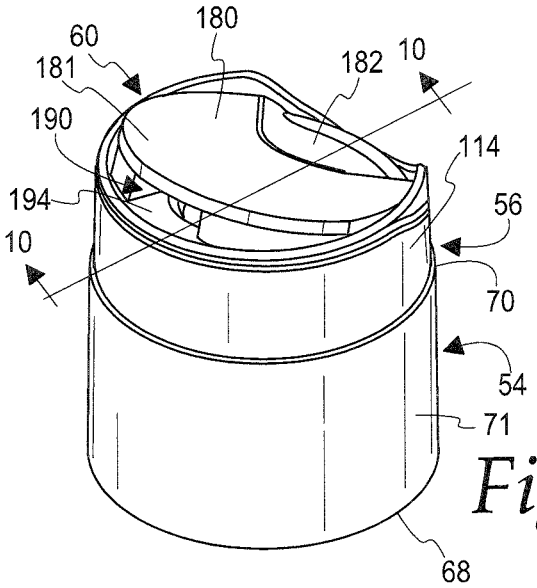
FIG. 9 is a similar perspective view of the closure shown in FIG. 1, however in FIG. 9 the actuator of the closure is has been rotated (i.e., pivoted or tilted) into an open, dispensing position and the container is not illustrated.

Referring to FIGS. 9 and 10, with the actuator 60 in the unlocking position, both abutments 216 of the actuator 60 are clear of the abutments 110 of the closure body 54, such that the user may move the actuator 60 from the closed position into the open position by depressing the sloping back region 182 of the actuator 60 to cause the actuator 60 to pivot within the recesses 144 of the locking member 56. As the user presses on the sloping back region 182 of the actuator 60, the two hemi-spherical projections 188 rotate within the recesses 144 of the locking member 56 such that the actuator 60 pivots about the pivot axis "P".

The cam element 212 slides down into the locking member 56 against the wall 114 when the actuator 60 moves into the open position. The cam element 212 stabilizes and maintains the actuator 60 in the open position by frictional engagement with the wall 114 of the locking member 56.

Referring to FIG. 10, as the actuator 60 pivots open, the plug 200 lifts partially out of the spout 138 so that the outlet end 194 of the dispensing flow passage 190 is exposed to the ambient environment. The user may then grasp the flexible, resilient container 44 to collapse or otherwise reduce the internal volume of the container 44 to pressurize the fluent substance contained therein. In some situations, the user may also invert the container 44. During dispensing of the fluent substance, the fluent substance initially enters the inlet flow passage 74 of the closure body 54, flows through intermediate flow passage 140 of the locking member 56, enters into the dispensing flow passage 190 of the actuator 60, and exits the closure 40 from the exposed outlet end 194.

When the user ceases to squeeze (i.e., pressurize) the container 44, the outward flow of the fluent substance is stopped and may even be sucked back toward the container 44 by a temporary lower pressure within the container 44 (e.g., if the container has resilient walls that return from a "squeezed in" configuration to the normal undeformed configuration). This allows some of the fluent substance within the dispensing flow passage 190, the intermediate flow passage 140, and/or the inlet flow passage 74 to be forced by the greater ambient air pressure back through the closure 40 and toward the container 44 to help maintain the overall cleanliness of the package.

Referring to FIGS. 10 and 5, the user may then move the actuator 60 from the open position (FIG. 10) into the closed position (FIG. 5) by depressing the front region 181 of the actuator 60 (which is located on the opposite side of the pivot axis "P" (FIG. 8) from the sloping back region 182) to cause the two hemi-spherical projections 188 (FIG. 8) to pivot within the recesses 144 (FIG. 8) of the locking member 56. The pivoting movement of the actuator 60 causes the plug 200 to re-seal within the spout 138 and also conceals the outlet end 194 of the dispensing flow passage 190 from the ambient environment.

With reference to FIGS. 5 and 7, the user may then grasp the locking member 56 by the outer wall 114 and twist or rotate the locking member 56 clockwise relative to the closure body 54 from the unlocking position back into the locking position. The inventor has found that the flexible seal formed between the body 54 and the locking member 56 permits a fluid tight seal while advantageously reducing or minimizing the rotational friction or torque that may be developed between the two parts, and which would need to be overcome by a user of the closure 40 to move the locking member 56 between its locking and unlocking positions, thus further improving the operability of the closure 40 compared to the those of the prior art.

As can be seen in FIG. 7, rotation of the locking member 56 clockwise causes the three arcuate slots 122 to move relative to the three retaining projections 94 received within them, and further causes the arcuate aperture 126 to move relative to the closure body abutments 110. The actuator 60 rotates through an angle of about thirty degrees about the central rotational axis "A" (FIG. 2) between the unlocking position (FIG. 8) and the locking position (FIG. 7). With the locking member 56 oriented in the locking position, the abutments 216 of the actuator 60 overlie the abutments 110 of the closure body 54. If the user attempts to move the actuator 60 from the closed position into the open position (e.g., such as by depressing the sloping back region 182 of the actuator 60), then the user would again be prevented by contact of the abutments 216 of the actuator 60 with the abutments 110 of the closure body 54.

When the user rotates the locking member 56 clockwise relative to the closure body 54 from the unlocking position toward the locking position, the locking member hemispherical bead 168 is urged out the second one of the closure body recesses 90, and the radially-extending projection 164 flexes upwardly from the resulting interference. Continued rotation of the locking member 56 relative to the closure body 54 toward the locking position causes the hemispherical bead 168 to slide along an arcuate path on the upper surface 82 of the closure body top deck 80. When the locking member 56 is rotated fully into the locking position, then the hemispherical bead 168 snaps into the first one of the closure body recesses 90. Release of potential energy and movement of the radially-extending projection 164 to an unstressed condition results in an audible and/or tactile indication to the user that the closure 40 is locked.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. A dispensing closure for a system having an opening between an exterior of the system and an interior of the system where a fluent substance may be stored, said dispensing closure comprising:

A. a closure body that
  1) can be located at the system opening and that defines an inlet for communicating with the system,
  2) has an upper end defining an aperture to accommodate the flow of a fluent substance through said closure body, and
  3) said closure body includes a pair of abutments extending upwardly from said upper end;

B. a locking member mounted on said closure body for rotation about a central rotational axis, said locking member having an intermediate flow passage for accommodating the flow of a substance through said closure body aperture, said locking member having
  1) a locking position, and
  2) an unlocking position rotated about said central rotational axis away from said locking position; and C. an actuator that
  1) is rotatably mounted to said locking member for occluding said locking member intermediate flow passage to prevent flow of a fluent substance through said closure when said actuator is in a closed, non-dispensing position and for permitting flow of a fluent substance through said closure when said actuator is rotated to an open, dispensing position,
  2) includes a dispensing flow passage that is in communication with said intermediate flow passage of said locking member when said actuator is in said open, dispensing position,
  3) includes a pair of downwardly extending abutments for confronting said pair of upwardly extending abutments extending from said upper end of said closure body when said locking member is in said locking position to prevent said actuator from moving into said open, dispensing position.

2. The dispensing closure in accordance with claim 1 in which said actuator rotates about a pivot axis relative to said locking member, said actuator dispensing flow passage is located on one side of said pivot axis, and said actuator includes a sloping back region located on another side of said pivot axis, and said pair of abutments of said closure body are located beneath said sloping back region when said locking member is in said locking position.

3. The dispensing closure in accordance with claim 1 wherein
  1) said locking member includes a bottom deck defining an aperture, and
  2) said pair of abutments of said closure body extend upwardly through said aperture.

4. The dispensing closure in accordance with claim 3 wherein said pair of downwardly extending abutments of said actuator are located above said aperture.

5. The dispensing closure in accordance with claim 1 wherein
  1) said closure body has a plurality of circumferentially spaced retaining projections, and
  2) said locking member has a plurality of circumferentially spaced arcuate slots therein, each one of said arcuate slots receiving a different one of said retaining projections.

6. The dispensing closure in accordance with claim 5 wherein said locking member includes a bottom deck defining an aperture, said pair of abutments of said closure body extend upwardly through said aperture, and said aperture is connected to one of said arcuate slots.

7. The dispensing closure in accordance with claim 1 wherein said pair of upwardly extending abutments of said closure body has a radius of curvature centered on said central rotational axis, and each one of said pair of downwardly extending abutments of said actuator has a length extending at an oblique angle relative to said radius of curvature with said locking member in said locking position.

8. The dispensing closure in accordance with claim 1 wherein said closure body further includes a flexible wall surrounding and defining said aperture, said flexible wall is movable in a radial direction relative to said central rotational axis to seal against a portion of said locking member.

9. The dispensing closure in accordance with claim 8 wherein said flexible wall includes a proximal end connected said upper end of said closure body and a cantilevered, distal end extending axially inwardly from said proximal end, said distal end including a radially inwardly extending sealing face.

10. The dispensing closure in accordance with claim 8 wherein said closure body includes an annular recess between said upper end and said flexible wall.

11. The dispensing closure in accordance with claim 1 in which said locking member includes a post extending upwardly therefrom.

12. The dispensing closure in accordance with claim 1 wherein
  1) said upper end of said closure body has an upper surface with at least one recess therein, and
  2) said locking member has at least one resilient projection having a bead, whereby rotation of said locking member relative to said closure body carries said projection in an arc with said bead engaging said surface so that said projection is deflected by said surface until continued rotation of said locking member relative to said closure body carries said projection to a location in which said at least one recess receives said bead whereupon said projection returns to its undeflected condition as said bead snaps into said at least one recess to generate at least one of an audible signal and a tactile signal.

13. The dispensing closure in accordance with claim 1 wherein said locking member has at least one indicium that cooperate to indicate whether said locking member is in one of said locking position and/or said unlocking position.

14. The dispensing closure in accordance with claim 1 wherein said locking member is rotatable less than 45 degrees about said central rotational axis between said locking position and said unlocking position.

15. The dispensing closure in accordance with claim 1 wherein
  1) said actuator includes a pair of oppositely extending protrusions, and 2) said locking member includes an outer wall having a pair of facing recesses therein to each receive a different one of said protrusions.

16. The dispensing closure in accordance with claim 1 in which 1) said locking member includes a raised central deck and a spout extending upwardly from said raised central deck, and 2) said intermediate flow passage extends through said raised central deck and said spout.

17. The dispensing closure in accordance with claim 1 in combination with a system that is a container of a fluent substance, the closure and container together defining a package.

18. The dispensing closure in accordance with claim 1 in which said closure body is adapted for use with a system that is a container defining said opening and in which said closure body is one of:

1) a separate structure for being attached to the container at the container opening; and 2) an integral structure that is a unitary part of a container formed at the container opening.

* * * * *